US005621367A

United States Patent [19]

Pöllänen

[11] Patent Number: 5,621,367

[45] Date of Patent: Apr. 15, 1997

[54] COAXIAL RESONATOR COMPRISING SLITS FORMED IN THE INNER CONDUCTOR

[75] Inventor: Ossi Pöllänen, Veikkola, Finland

[73] Assignee: Nokia Telecommunications Oy, Espoo, Finland

[21] Appl. No.: 545,840

[22] PCT Filed: May 13, 1994

[86] PCT No.: PCT/FI94/00192

§ 371 Date: Jan. 11, 1996

§ 102(e) Date: Jan. 11, 1996

[87] PCT Pub. No.: WO94/27337

PCT Pub. Date: Nov. 24, 1994

[30] Foreign Application Priority Data

May 13, 1993 [FI] Finland ..... 932179

[51] Int. Cl.[6] ..... H01P 7/04

[52] U.S. Cl. ..... 333/224; 333/222; 333/223; 333/231; 333/232

[58] Field of Search ..... 333/222–224, 333/227, 231, 232

[56] References Cited

U.S. PATENT DOCUMENTS

| | | | |
|---|---|---|---|
| 2,562,921 | 8/1951 | Kandoian | 333/222 |
| 4,906,955 | 3/1990 | Yorita et al. . | |
| 4,954,796 | 9/1990 | Green et al. | 333/222 |
| 5,105,174 | 4/1992 | Cruchon et al. | 333/232 |

FOREIGN PATENT DOCUMENTS 2067848 7/1981 United Kingdom .

*Primary Examiner*—Robert Pascal
*Assistant Examiner*—Darius Gambino
*Attorney, Agent, or Firm*—Cushman Darby & Cushman IP Group of Pillsbury Madison & Sutro LLP

[57] ABSTRACT

The invention relates to a coaxial resonator comprising an inner conductor (12) with walls defining therebetween a free space (24), and a housing portion (13) surrounding the inner conductor (12) and forming an outer conductor of the resonator. In order that connection to the inner conductor could be made very simply, the inner conductor (12) is made of sheet material in which slits (21; 33) extending in the direction of the inner conductor are made so that they form between them a tongue-like connecting part (22; 34) having its free end connected to a printed circuit board (11).

4 Claims, 2 Drawing Sheets

COAXIAL RESONATOR COMPRISING SLITS FORMED IN THE INNER CONDUCTOR

This application claims benefit of international application PCT/FI94/00192, filed May 13, 1994.

FIELD OF THE INVENTION

The invention relates to a coaxial resonator comprising an inner conductor with walls defining therebetween a free space, and a housing portion surrounding the inner conductor and forming an outer conductor of the resonator.

BACKGROUND OF THE INVENTION

Various coils and capacitors are used widely as components in electro-technical devices, such as oscillators and filters. With increasing frequencies the losses of capacitors and coils, however, increase to such an extent that various cavity and coaxial resonators and dielectric resonators are the only alternative in terms of losses.

Particularly within the frequency range from 1 to 10 GHz, where the resonator according to the invention is to be used, cavity resonators are often large and require special components with expensive packings. The use of dielectric resonators in turn results in a structure having the disadvantages of e.g. being difficult to assemble and difficult to tune electrically. Having low losses, coaxial resonators are the most widely used especially at high powers. The losses of coaxial resonators decrease with increasing resonator sizes while their power handling capacity increases. A disadvantage of a resonator made of a conventional coaxial conductor is its difficult frequency adjustment, but if the resonator is provided with an inner conductor open in the middle, the frequency is easy to adjust by an adjusting screw or a similar adjusting means, which extends inside the inner conductor of the resonator. The present invention, in fact, is based on a coaxial resonator having the advantages described above and allowing the frequency to be adjusted as described above.

In the prior art resonator structure having the above-described properties, the inner conductor is implemented as a thick-wall metal tube into which the frequency adjusting means penetrates. Devices based on this basic structure (e.g. oscillators) have previously been implemented by bringing the active components surrounding the resonator, such as transistors, varactors and Gunn diodes, into galvanic contact with the side of the inner conductor. This has required the use of expensive (special) components. If the resonator has been used in a filter, it has been necessary to connect the inner conductor to an output connector by a separate conductor wire. Coupling to the inner conductor of the resonator has thus involved a complicated structure difficult to implement and possibly also requiring components more expensive than usually.

SUMMARY OF THE INVENTION

The object of the present invention is to avoid the above disadvantages by improving the basic structure of the coaxial oscillator described in the beginning in such a way that connection to the inner conductor can be made very simply. This object is achieved by a coaxial resonator according to the invention, which is characterized in that the inner conductor is made of sheet material in which slits extending in the direction of the inner conductor are made so that they form between them a tongue-like connecting part having its free end connected to a printed circuit board.

The basic feature of the invention is that slits extending in the (longitudinal) direction of the inner conductor are formed in the (thin) wall of the inner conductor in a manner such that a connecting tongue is formed between the slits, which is easy to solder to a printed circuit board at its free end.

The solution according to the invention also allows resonator of a high Q factor to be produced which is easy to realize, suitable for series production and advantageous in costs.

BRIEF DESCRIPTION OF THE DRAWINGS

In the following the invention and its preferred embodiments will be described more fully with reference to the examples shown in the attached drawings, where.

DESCRIPTION OF THE PREFERRED EMBODIMENTS

Figure 1:
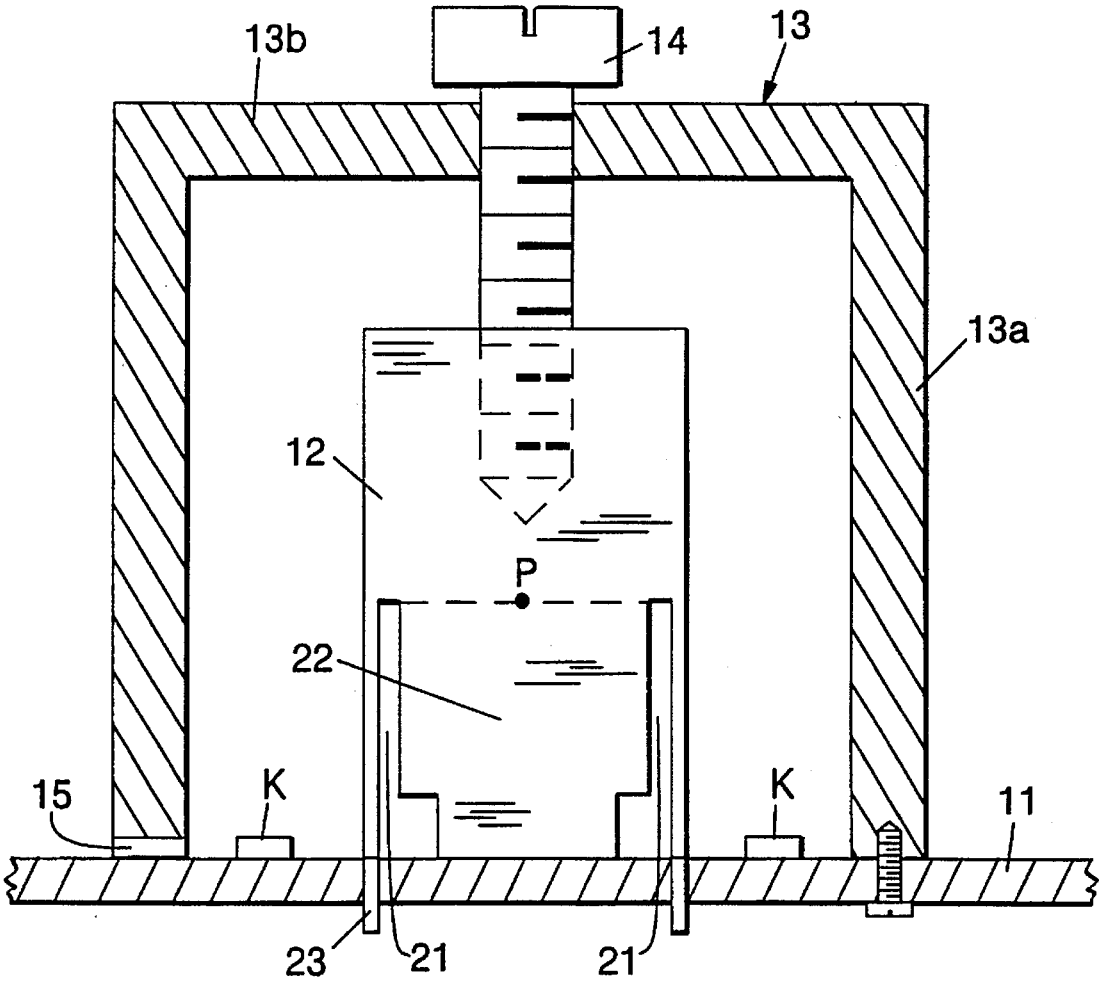
FIG. 1 is a cross-sectional view of a coaxial resonator according to the invention.

FIG. 1 is a cross-sectional view illustrating a coaxial resonator according to the invention placed on a printed circuit board 11.

The resonator comprises an inner conductor 12 which is metallized or made of metal and open at the upper end and attached to the printed circuit board 11 at the lower end. In this specific case, the inner conductor is a tubular body having a substantially quadratic cross-section. The walls of the tubular body define therebetween a free (air) space.

The outer conductor of the resonator is formed by a housing portion 13 which is metallized or made of metal and comprises side walls **13*a* and a cover 13*b* interconnecting the walls at the top. The housing portion is attached at the lower end to the printed circuit board 11 and connected to the ground plane of the printed circuit board. The housing portion encloses not only the inner conductor 12 but also other components possibly placed on the printed circuit board (in a filter, for instance, no such components positioned inside the housing portion are needed). These components are shown schematically, and indicated by the reference K. In order that the inner conductor and the other components possibly positioned within the housing could be connected to circuit components positioned outside the resonator, grooves 15 relatively narrow in the sideward direction are formed at the bottom edge of the side walls of the housing portion. Connections on the printed circuit board can be made through channels formed by the grooves 15**.

In order that the frequency of the resonator could be adjusted, the cover of its housing portion is further provided with a frequency adjusting screw 14 so that the tip of the screw can be displaced inside the inner conductor open in the middle so that the length of the tip portion entering inside the inner conductor is adjustable.

Figure 2:
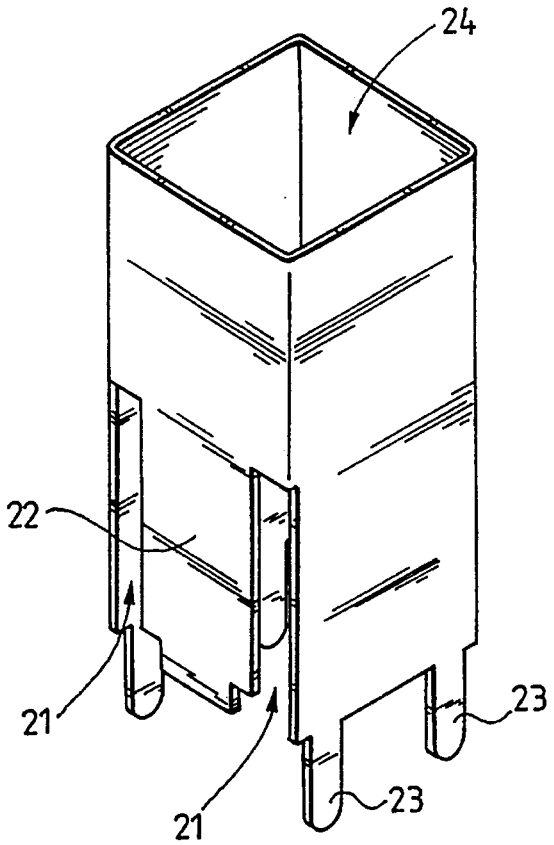
FIG. 2 is a perspective view of an inner conductor in a coaxial resonator according to the invention.

FIG. 2 is a more detailed view of the inner conductor 12 of the resonator. The inner conductor defines within it a free space 24, into which the frequency adjusting screw 14 enters. According to the invention, the inner conductor is made of sheet material in which slits 21 extending in the direction of the inner conductor are formed so that they define between them a tongue-like connecting part 22 having its free end soldered to a metal foil (not shown) placed on the printed circuit board 11. In this way, the connecting part 22 forms a connection wire, by means of which external circuit components can be connected to the inner conductor of the resonator in a very simple way. The lower portion of the inner conductor comprises feet 23, on which the inner conductor stands on the printed circuit board (and by means of which the inner conductor is connected to the ground plane of the printed circuit board). As appears from FIG. 1, the feet 23 extend through the printed circuit board 11, and the free end of the connecting part 22 extends substantially down to the level of the printed circuit board.

The electric requirements set on each particular circuit determine how high (how far) the slits 22 extend. The longer the slits, the stronger the coupling to external components, such as varactors and transistors, and vice versa, the shorter the slits, the weaker the coupling to external components. In each particular case, the optimum length of the slits can be determined on the basis of the requirements set on the electric properties of the circuit. In FIG. 1, the connection point at this optimum is indicated with the reference P. The mutual spacing between the slits affects the inductance of the tongue-like connecting part; the inductance can be used as a parameter in the design of the structure.

Figure 3:
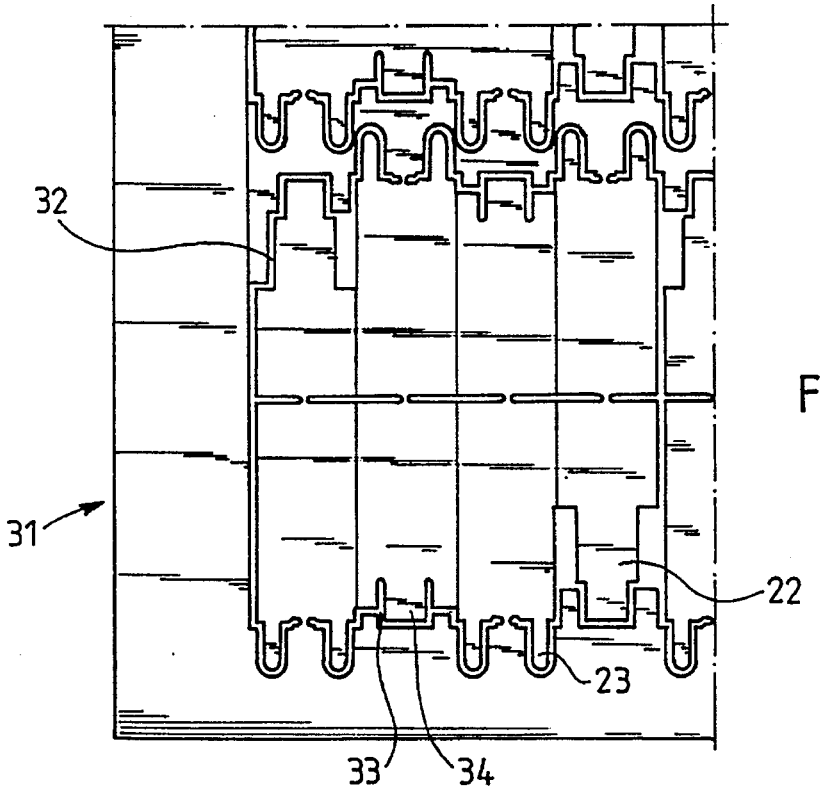
FIG. 3 illustrates a preferred way of producing the inner conductor of the resonator.

Inner conductors are preferably made, as shown in FIG. 3, of a larger sheet, e.g. a copper sheet 31, in which openings 32 forming inner conductor blanks are made e.g. by etching, blanking or flame cutting (by laser, for instance). The blanks are removed from the sheet by bending, and then folded into a shape shown in FIG. 2. Opposite edges are soldered together. Etching is the most advantageous way of production in that it does not require any expensive tools.

FIG. 3 also shows slits 33 positioned on the opposite wall of the inner conductor with respect to the slits 21. The slits 33 define therebetween a tongue-like connecting part 34, which forms a second connection wire of the inner conductor in the same way as the connecting part 22 forms its first connection wire. Both the slits 21 and the slits 33 have a certain vertical tolerance area around the connection point (the connection point P for the slits 21) positioned at the optimum, where the connection operates appropriately.

The structure of the inner conductor according to the invention is such that it can be soldered to the printed circuit board in a simple manner and that it allows a simple connection. In addition, its basic structure allows the frequency adjustment to be performed from the outside by means of a screw or the like. For the idea of the invention, these frequency adjusting means, however, are not necessary even though they form part of the preferred embodiment of the structure.

Even though the invention has been described above with reference to the examples shown in the attached drawings, it is obvious that the invention is not limited to them, but it may be modified in various ways within the inventive idea disclosed above and in the attached claims. For instance, the resonator may also be positioned on its side with respect to the printed circuit board 11, in which case the slits would extend horizontally in the direction of the inner conductor. One end of the inner conductor thereby has to be turned to the printed circuit board, which makes the structure more complicated than the one described above. However, a resonator positioned on its side can be fitted into a lower space than an upright resonator. It is also possible to make the inner conductor of a tube round in cross-section. Accordingly, when it is stated herein that the inner conductor is made of sheet material, it is to be understood to include inner conductors of different cross-sections, open in the middle and having walls made of (thin) sheet material. The inner conductor may also be filled with dielectric material, either entirely or in such a way that a free space is left only for the frequency adjusting means, provided that the resonator has such means. As used in the above description and in the attached claims, the free space or the inner conductor open in the middle means that the walls of the inner conductor define therebetween a space which may be filled or left totally or partially free, as required in each specific case. It is also possible to fill the free space defined between the housing portion and the inner conductor with a dielectric material.

I claim:

1. Coaxial resonator comprising an inner conductor (12) with walls defining therebetween a free space (24), and a housing portion (13) surrounding the inner conductor (12) and forming an outer conductor of the resonator, characterized in that the inner conductor (12) is made of sheet material in which slits (21; 33) extending in the direction of the inner conductor are made so that they form between them a tongue-like connecting part (22; 34) having its free end connected to a printed circuit board (11).

2. Resonator according to claim 1, characterized in that the inner conductor (12) is in an upright position with the slits (21; 33) extending from the bottom upwards, and both the connecting part (22; 34) and the lower end (23) of the inner conductor (12) are attached to the printed circuit board (11).

3. Resonator according to claim 1, characterized in that the inner conductor (12) is substantially rectangular in cross-section.

4. Resonator according to claim 1, characterized in that the inner conductor (12) is provided with a frequency adjusting means (14) extending from outside the housing portion (13) through the free end of the inner conductor (12) into the free space defined inside the inner conductor.

* * * * *